US006575821B2

(12) United States Patent
Jöst

(10) Patent No.: US 6,575,821 B2
(45) Date of Patent: Jun. 10, 2003

(54) ABRASIVE BELT FOR A BELT GRINDING MACHINE

(76) Inventor: Peter Jöst, Hardbergstrasse 19, D-69518 Abtsteinach (DE)

( * ) Notice: Subject to any disclaimer, the term of this patent is extended or adjusted under 35 U.S.C. 154(b) by 26 days.

(21) Appl. No.: 09/838,770

(22) Filed: Apr. 19, 2001

(65) Prior Publication Data

US 2002/0016144 A1 Feb. 7, 2002

(30) Foreign Application Priority Data

Aug. 1, 2000 (DE) ..... 200 13 377
Feb. 13, 2001 (EP) ..... 01103306

(51) Int. Cl.[7] ..... B24D 11/00
(52) U.S. Cl. ..... 451/526; 296/537
(58) Field of Search ..... 451/526, 527, 451/537, 538, 539, 453, 296, 168

(56) References Cited

U.S. PATENT DOCUMENTS 2,804,733 A 9/1957 Hurst
5,782,679 A * 7/1998 Hunter ..... 451/296
5,810,650 A * 9/1998 Jost ..... 451/527
5,910,471 A 6/1999 Christianson et al.

FOREIGN PATENT DOCUMENTS

DE 295 20 566 U1 4/1996
EP 0716903 6/1996
WO 9906182 2/1999

OTHER PUBLICATIONS

Patent Abstracts of Japan, vol. 012, No. 442 (M–766), Nov. 21, 1988 & JP 63 174878 A (Kuraray Co Ltd), Jul. 19, 1988.
Patent Abstracts of Japan, vol. 018, No. 466 (P–1794), Aug. 30, 1994 & JP 06 150306 A (Sony Corp), May 31, 1994.

* cited by examiner

*Primary Examiner*—Dung Van Nguyen
(74) *Attorney, Agent, or Firm*—Friedrich Kueffner

(57) ABSTRACT

An abrasive belt for a belt grinding machine has a support layer, an intermediate layer connected to the support layer, and an abrasive layer connected to the intermediate layer. The support layer transmits a drive output of the belt grinding machine onto the abrasive layer. The abrasive layer allows flow of grinding particles through the abrasive layer. The intermediate layer also allows flow of the grinding particles through the intermediate layer, and the support layer allows flow of the grinding particles through the support layer.

10 Claims, 1 Drawing Sheet

ABRASIVE BELT FOR A BELT GRINDING MACHINE

BACKGROUND OF THE INVENTION

1. Field of the Invention

The invention relates to a belt grinding machine with an abrasive layer and a support layer for transmitting drive power onto the abrasive layer.

2. Description of the Related Art

It is known to employ an endless belt guided about at least two rollers in belt grinding machines, wherein at least one of the rollers is being driven. The abrasive layer is positioned externally, i.e., on the side facing away from the rollers while the support layer rests on the rollers. When the rollers are now rotated, the support layer is entrained and thus also the abrasive layer on the external side of the belt. In general, the inner side of one of the runs of the belt has positioned thereat a pressing shoe with which the moving abrasive belt is forced against the surface to be ground in order to provide a certain grinding pressure.

Such abrasive belts are used preferably for grinding plane surfaces. Belt grinding machines can be in the form of portable hand-held tools or can also be stationary tools.

During the grinding process grinding dust is formed which causes certain problems. On the one hand, the grinding dust causes a certain environmental impact which may result in health problems for the person operating the belt grinding machine. On the other hand, the grinding dust also clogs the abrasive layer so that the effectiveness of the abrasive layer is reduced. Accordingly, the abrasive belt in some cases has a service life which is significantly smaller than to be expected based on wear of the abrasive layer.

It has therefore already been suggested to remove the grinding dust by a suction action from the abrasive belt. For this purpose, the belt grinding machine, in the area of one deflecting roller, is provided with a suction device which acts on the external side of the abrasive belt and is designed to remove by suction the grinding dust from the surface of the abrasive layer. The effectiveness of such a suction device is however limited.

SUMMARY OF THE INVENTION

It is an object of the present invention to improve the grinding dust removal on abrasive belts.

In accordance with the present invention, this is achieved in that the abrasive layer is configured to allow particle flow therethrough, in that between the abrasive layer and the support layer an intermediate layer is arranged which is configured to allow particle flow, and in that the support layer is also configured to allow particle flow.

It is possible to provide a removal device operating by suction on the inner side of the abrasive belt which then substantially sucks the grinding dust through the abrasive belt. The grinding dust (grinding particles) can thus be removed at the location where it is generated, i.e., it does not stay or stays only for a very short time period on the surface of the abrasive layer. The particle flow, i.e., the grinding dust which is transported by air flow through the abrasive belt, penetrates first the abrasive layer. For this purpose, different possibilities are provided which will be discussed in more detail in the following. Below the abrasive layer an intermediate layer is arranged which is also configured to allow passage of grinding dust (grinding particles). In this intermediate layer, the grinding dust has the possibility to select a path which is no longer perpendicular to the grinding plane. The grinding dust can move, if necessary, also parallel to the abrasive layer. This makes it possible for the particles to penetrate the support layer at a suitable location, wherein the support layer is also configured to allow particle flow therethrough. Accordingly, it is no longer necessary that at the time of removal by suction during the grinding process an opening provided in the abrasive layer is positioned exactly aligned with a suction opening. Instead, the location and arrangement of a suction device within the belt grinding machine and within certain surface areas of the abrasive belt can be selected freely within certain limits. This has the result that the grinding dust removal functions even when the abrasive belt is moving, i.e., the abrasive layer is moving across the surface to the ground. For example, the corresponding suction device can be arranged behind the pressing shoe in the running direction of the abrasive belt or the pressing shoe can be provided with corresponding suction openings. As a result of the abrasive belt being permanently exposed to the suction action, an excellent possibility is provided to transport the grinding dust away form the abrasive surface. The service life of the abrasive belt is increased accordingly; moreover, the grinding dust is not released into the surroundings and the abrasive layer will not become clogged so quickly with the grinding dust.

In this connection, it is preferred that the support layer is formed of a material which is impenetrable for particles but is provided with a plurality of holes which are substantially uniformly distributed across its surface area. Since it is possible to employ material for the support layer that is impenetrable for the particles stream, the selection of materials for the support layer is not limited. It is possible to employ the same support material as for conventional abrasive belts. The material can be selected, in particular, with respect to the strength which must be provided by the support layer. The support material should also be, in particular, resistant to tearing. Overall, it is sufficient when the combination of abrasive layer, intermediate layer, and support layer has sufficient tensile strength. Optionally, the support layer can also be formed by a part of the intermediate layer. The particle stream through the support layer is ensured in that the support has a plurality of holes which are uniformly distributed across its surface area. These holes can be provided in the form of perforations. The fact that the holes are uniformly distributed across the surface area does not mean that in all cases a regular pattern must be present. It is only required that the ratio of open surface area to remaining support layer surface area is substantially constant across the entire surface area of the support layer when surface area portions of a few square centimeters, for example, 10 $cm^2$, or less are considered.

Preferably, the holes have a maximum spacing relative to one another which as a function of the intermediate layer is selected such that a substantially dynamic pressure-free particle flow can be generated beginning at the abrasive layer and passing through the intermediate layer and through the holes. Accordingly, the holes can have a spacing relative to one another that is the greater the easier the dust particles can flow parallel to the support layer through the intermediate layer.

Preferably, the intermediate layer is an open-pore foam. Such foam can be realized, for example, by a foamed material layer. The foamed material layer makes it possible for the dust particles to move basically in all directions. The dust can thus flow within the foamed material layer from the abrasive layer to the individual holes in the support layer.

Preferably, the intermediate layer is elastic. In addition to the function of providing a flow path for the particle flow, the intermediate layer also takes over the function of configuring the abrasive belt so as to yield to certain degree so that smoother surfaces can be obtained.

Preferably, the support layer is made of paper, fabric or film. These materials have proven successful in practice. They can transmit high tensile forces and are relatively inexpensive. The film is preferably a plastic film. It is also possible to employ a non-woven or other material of less tensile-strength when the abrasive belt otherwise overall is of great tensile strength or can operate in a different way.

Preferably, the abrasive layer has an abrasive particle support comprised of a material which is impenetrable for a particle flow therethrough but has an arrangement of a plurality of perforations over its surface area. In this connection, basically the same considerations as for the support layer apply. The perforations are arranged such that the dust which is produced during grinding must not travel large distances on the surface of the abrasive layer but can be sucked relatively quickly through the next perforation into the interior. The perforations must not be provided in a certain pattern even though this facilitates their manufacture. The use of a material which is impenetrable to a particle flow has the advantage that for the abrasive particle support materials can be also used which have been proven successful in practice. The permeability for the particle flow is provided by the perforations.

Preferably, the perforations have a diameter in the range of 0.5 to 5 mm and neighboring perforations have a maximum spacing to one another of 20 mm, wherein the maximum spacing of the edge to the next perforation is 15 mm. Conventionally, the spacings between neighboring perforations and the spacing of the edge at each location next to a perforation are of even smaller values, for example, in the range of magnitude of 10 mm. This provides relatively short travel distances which must be traveled by the grinding dust on the surface of the abrasive belt before it can be sucked into the next perforation.

Preferably, the abrasive particle support is formed of paper, fabric, or film. The film may be particularly a plastic film. On these materials, abrasive particles, for example, the abrasive grain, can be easily attached.

In an alternative embodiment it is proposed that the abrasive layer is formed as an abrasive grate. With such an abrasive grate it is possible to obtain especially fine grinding results. In the case of an abrasive grate, the particle flow can penetrate through the openings which are formed by the individual mesh openings of the grate.

DESCRIPTION OF THE PREFERRED EMBODIMENTS

Figure 1:
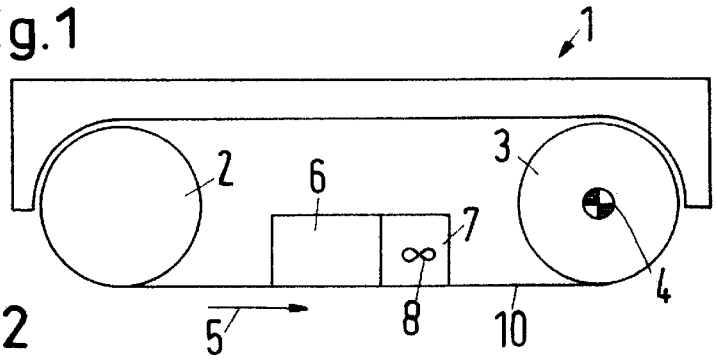
FIG. 1 is a schematic side view of a belt grinding machine.

FIG. 1 shows schematically the belt grinding machine 1, wherein an abrasive belt 10 is guided about two deflection rollers 2, 3 and tensioned, wherein the deflection roller 3 has a drive 4. The means for tensioning the abrasive belt 10 are not illustrated. The abrasive belt 10 is driven by the deflection roller 3 in the direction of arrow 5. The pressing shoe 6 is arranged at the inner side of the abrasive belt 10, more precisely, at its free run. With the aid of the pressing shoe 6, the lower run of the abrasive belt 10 can be pressed against the surface that is to be ground. In the running direction 5 behind the pressing shoe 6 a removal device 7 is provided which operates by suction and is symbolically shown by the schematically illustrated fan 8.

Figure 2:
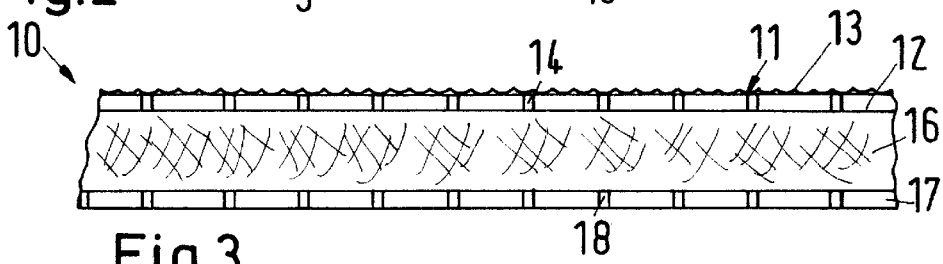
FIG. 2 is a cross-sectional view of an abrasive belt according to a first embodiment of the invention.

FIG. 2 shows a first configuration of the abrasive belt 10 in cross-section. The abrasive belt 10 has an abrasive layer 11 which is formed of an abrasive particle support 12, for example, made of paper, fabric, or a plastic film on which abrasive grain 13 or other abrasive material is attached, for example, by adhesives or by being embedded in a plastic matrix.

Figure 4:
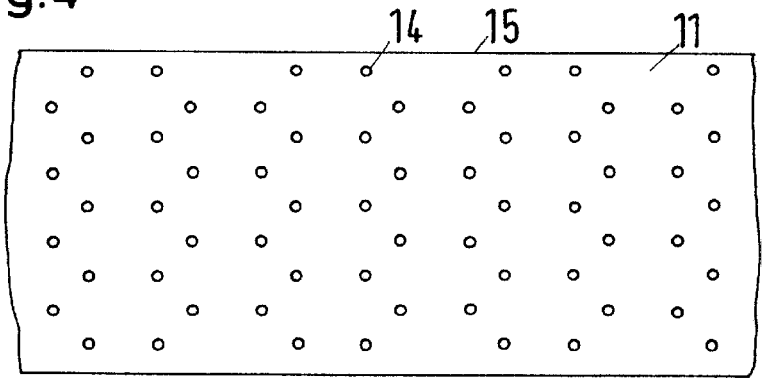
FIG. 4 is a plan view onto the abrasive layer of the abrasive belt according to FIG. 2.

The abrasive particle support 12 is comprised of a material which is impenetrable for the particle flow, i.e., the material itself is so dense that no dust particles can penetrated. However, the abrasive particle support 12 is provided with a plurality of perforations 14 which are large enough to allow passage of the dust therethrough. The arrangement of these perforations 14 can be seen in FIG. 4. The perforations 14 have a diameter in the range of 0.5 to 5 mm. In general, this diameter is approximately 2 mm. Instead of a circular shape, the perforations 14 can have basically any desired shape as long as it is ensured that during grinding the resulting dust can penetrate through the perforations 14. Of course, the perforations 14 penetrate the abrasive layer completely, i.e., also the abrasive grain. The maximum spacing between two neighboring perforations 14 is 20 mm. Preferably, a spacing of only 7 to 10 mm is selected. Also, the maximum spacing of the edge 15 (parallel to the movement direction 5) to the next perforation 14 is 20 mm. It is thus ensured that the grinding dust which is produced during grinding must travel maximally this distance before it is sucked into the closest perforation 14.

On the side of the abrasive particle support 12 facing away from the abrasive grain 13, an intermediate layer 16 is arranged which is comprised of foamed material. The foamed material 16 is of an open-pore configuration, i.e., it is also configured to allow passage of the particle flow. The particle flow in this connection is not limited to a direction perpendicular to the extension of the abrasive particle support 12 but the particle flow can move basically in any direction within the intermediate layer 16. The main direction of the particle flow will extend from the abrasive layer 11 to the support layer 17 which is resting on the deflection rollers 2, 3. In the context of this movement, however, there will be flow paths formed which have a component that is parallel to the extension of the abrasive particle support 12.

The support 17 is pull-resistant, i.e., it is not significantly extended when it is driven by the rollers 2, 3. Basically, it is sufficient when this pull resistance is provided by the abrasive belt 10 as a whole. When the intermediate layer 16 is stable enough, it can also take over the function of the support layer 17, i.e., the support layer 17 is then formed as a part of the intermediate layer 16.

Figure 5:
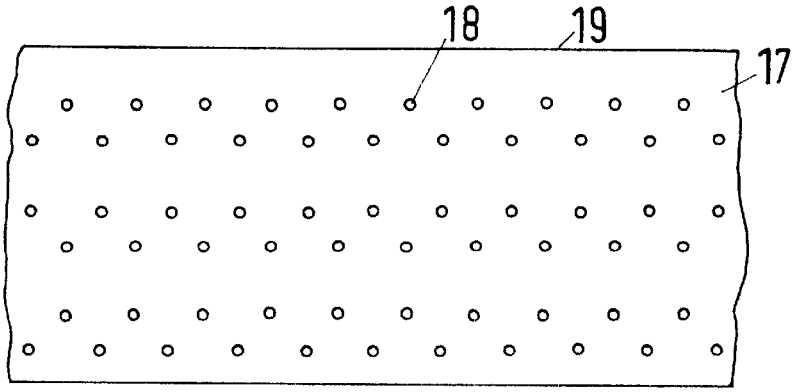
FIG. 5 is a plan view onto the support layer of the abrasive belt.

The support layer 17 is also comprised of a material which is impenetrable for the particle flow. In a way similar to that described in connection with the abrasive layer 11, the support layer 17 is also perforated. This can be seen, for example, in FIG. 5 which is a plan view onto the support layer 17 having holes 18. A comparison of FIG. 4 and FIG.

5 shows that the arrangement of the perforations 14 and of the holes 18 must not coincide, i.e., it is not necessary that each of the perforations 14 has a hole 18 aligned therewith, even though this is, of course, possible. The particle flow which passes through the perforations 14 seeks instead a path through the intermediate layer 16 until it can exit through the holes 18 of the support layer 17. Also, the holes 18 of the support layer 17 have a diameter in the range of 0.5 to 5 mm, preferably 2 mm, and a maximum spacing relative to one another of 20 mm, preferably 7 to 10 mm. The spacing of the holes 18 to the edge 19 is also maximally 20 mm. This spacing can be selected generally to be larger than the spacing of the perforations 14 to the edge 15 of the abrasive layer 11.

Figure 3:
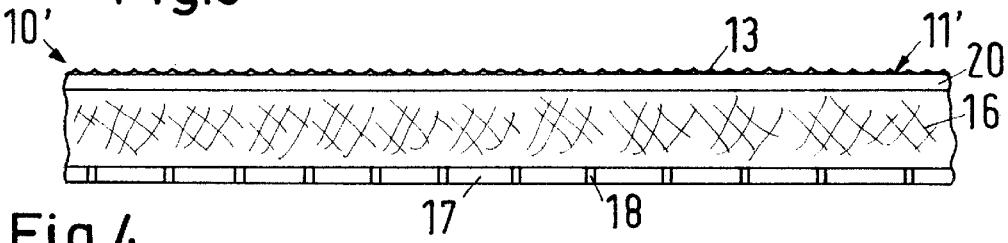
FIG. 3 is cross-sectional view of an abrasive belt according to a second embodiment of the invention.

FIG. 3 shows an alternative embodiment of an abrasive belt 10' in which the abrasive layer 11' is of a different configuration. The abrasive layer 11' in this embodiment is formed by an abrasive grate 20, i.e., a net-like or grid-like surface member having stays on which the abrasive grain 13 is fastened. The particle flow can penetrate through the mesh openings of the abrasive grate 20 and can reach the holes 18 in the support layer 17 through the intermediate layer 16.

When the abrasive belt 10 in operation is placed onto a surface to be ground and is driven, ground-off material in the form of grinding dust results mainly in the area of the pressing shoe 6. At the same time, the suction device 7 produces airflow through the abrasive belt 10 which ensures that the grinding dust, which is transported with the abrasive belt 10 in the direction toward the suction device 7, is directly removed by suction through the abrasive belt 10, 10'. In this connection, the intermediate layer 16 functions as a distributor, i.e., it ensures that the grinding dust, which has penetrated through the perforations 14 or the abrasive grate 20, can reach such holes 18 in the support layer 17 which are subjected to underpressure.

The grinding dust is thus permanently and reliably removed so that the abrasive layer 11, 11' will not become clogged and the abrasive belt 10, 10' thus is provided with a longer service life.

While specific embodiments of the invention have been shown and described in detail to illustrate the inventive principles, it will be understood that the invention may be embodied otherwise without departing from such principles.

What is claimed is:

1. An abrasive belt for a belt grinding machine, the abrasive belt comprising:

a support layer;

an intermediate layer connected to the support layer;

an abrasive layer connected to the intermediate layer;

wherein the support layer is configured to transmit a drive output of the belt grinding machine onto the abrasive layer;

wherein the abrasive layer is configured to allow flow of grinding particles through the abrasive layer;

wherein the intermediate layer is configured to allow flow of the grinding particles through the intermediate layer;

wherein the support layer is configured to allow flow of the grinding particles through the support layer;

wherein the support layer is comprised of a material that is impenetrable to the grinding particles, but the support layer has a plurality of holes distributed uniformly over the surface area of the support layer; and wherein the holes have a maximum spacing to one another, wherein the maximum spacing is selected depending on the intermediate layer such that an essentially dynamic pressure-free grinding particle flow is generated through the abrasive layer, the intermediate layer, and the holes of the support layer.

2. The abrasive belt according to claim 1, wherein the intermediate layer is an open-pore foam.

3. The abrasive belt according to claim 1, wherein the intermediate layer is elastic.

4. The abrasive belt according to claim 1 wherein the support layer is comprised of paper, fabric, or film.

5. The abrasive belt according to claim 1, wherein the abrasive layer is an abrasive grate.

6. The abrasive belt according to claim 1, wherein the abrasive layer is an abrasive grate.

7. The abrasive belt according to claim 1, wherein the intermediate layer is configured to allow grinding particles to move within the intermediate layer parallel to the abrasive layer.

8. An abrasive belt for a belt grinding machine, the abrasive belt comprising:

a support layer;

an intermediate layer connected to the support layer;

an abrasive layer connected to the intermediate layer;

wherein the support layer is configured to transmit a drive output of the belt grinding machine onto the abrasive layer;

wherein the abrasive layer is configured to allow flow of grinding particles through the abrasive layer;

wherein the intermediate layer is configured to allow flow of the grinding particles through the intermediate layer;

wherein the support layer is configured to allow flow of the grinding particles through the support layer;

wherein the abrasive layer comprises an abrasive particle support comprised of a material that is impenetrable to the grinding particles, but the abrasive particle support has a plurality of perforations distributed uniformly over the surface area of the abrasive particle support;

wherein the perforations have a diameter in the range of 0.5 mm to 5 mm, wherein neighboring perforations have a maximum spacing from one another of 20 mm.

9. The abrasive belt according to claim 8, wherein the abrasive particle support is comprised of paper, fabric, or film.

10. The abrasive belt according to claim 8, wherein the abrasive belt has edges and wherein the edges have a maximum spacing of 15 mm to the next closest perforation.

* * * * *